US007381031B2

(12) United States Patent
Kawaguchi et al.

(10) Patent No.: US 7,381,031 B2
(45) Date of Patent: Jun. 3, 2008

(54) CONTROL VALVE FOR VARIABLE DISPLACEMENT COMPRESSOR

(75) Inventors: Takeshi Kawaguchi, Tokyo (JP); Morimitsu Kajiwara, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 444 days.

(21) Appl. No.: 11/041,226

(22) Filed: Jan. 25, 2005

(65) Prior Publication Data

US 2005/0169768 A1 Aug. 4, 2005

(30) Foreign Application Priority Data

Jan. 29, 2004 (JP) ..... 2004-020969

(51) Int. Cl.
*F04B 1/26* (2006.01)

(52) U.S. Cl. ..... 417/222.2

(58) Field of Classification Search ..... 417/222.2; 251/129.15, 129.16

See application file for complete search history.

(56) References Cited

U.S. PATENT DOCUMENTS 3,174,433 A * 3/1965 Roosa ..... 417/413.1
5,242,274 A * 9/1993 Inoue ..... 417/222.2
6,939,112 B2 * 9/2005 Taguchi ..... 417/222.2
6,974,311 B2 * 12/2005 Sakai et al. ..... 417/222.2
2003/0145615 A1 * 8/2003 Sasaki et al. ..... 62/228.3
2004/0086391 A1 * 5/2004 Hirota et al. ..... 417/222.2

FOREIGN PATENT DOCUMENTS

EP 1 413 752 A1 4/2004
JP 2000-110731 4/2000
JP 2000-110731 A 4/2000
JP 2004-278511 10/2004

OTHER PUBLICATIONS

European Search Report dated Nov. 30, 2006 issued in corresponding European patent application No. 05 00 1578.

* cited by examiner

*Primary Examiner*—Charles G. Freay
*Assistant Examiner*—Vikansha Dwivedi
(74) *Attorney, Agent, or Firm*—Westerman, Hattori, Daniels & Adrian, LLP.

(57) ABSTRACT

A control valve for a variable displacement compressor that is mounted on the variable displacement compressor to control pressure within a hermetic crankcase to thereby change the discharging capacity of a refrigerant.

4 Claims, 8 Drawing Sheets

CONTROL VALVE FOR VARIABLE DISPLACEMENT COMPRESSOR

CROSS-REFERENCES TO RELATED APPLICATIONS, IF ANY

This application claims priority of Japanese Application No. 2004-020969 filed on Jan. 29, 2004 and entitled "CONTROL VALVE FOR VARIABLE DISPLACEMENT COMPRESSOR".

BACKGROUND OF THE INVENTION (1) Field of the Invention

The present invention relates to a control valve for a variable displacement compressor, and more particularly to a control valve for a variable displacement compressor which is suitable for controlling discharging capacity of refrigerant of a variable displacement compressor for an automotive air conditioner.

(2) Description of the Related Art

A compressor used in a refrigeration cycle of an automotive air conditioner is driven by an engine whose rotational speed is varied depending on a traveling condition of the vehicle, and hence is incapable of performing rotational speed control. For this reason, in general, a variable displacement compressor capable of changing discharging capacity of refrigerant is employed so as to obtain an adequate refrigerating capacity without being constrained by the rotational speed of the engine.

In the variable displacement compressor, in general, a wobble plate disposed within a crankcase formed gastight, such that the inclination angle thereof can be changed, is driven by the rotational motion of a rotational shaft, for performing wobbling motion, and pistons caused to perform reciprocating motion in a direction parallel to the rotational shaft by the wobbling motion of the wobble plate draw refrigerant from a suction chamber into associated cylinders, compress the refrigerant, and then discharge the same into a discharge chamber. In doing this, the inclination angle of the wobble plate can be varied by changing the pressure in the crankcase, whereby the stroke of the pistons is changed for changing the discharge amount of the refrigerant. The control valve for a variable displacement compressor provides control to change the pressure in the crankcase.

In general, such a control valve for a variable displacement compressor, which variably controls the discharge capacity of the compressor, operates to introduce part of refrigerant discharged from the discharge chamber and having discharge pressure Pd, into the crankcase formed gastight, such that pressure Pc in the crankcase is controlled through control of the amount of refrigerant thus introduced, which control is carried out according to suction pressure Ps in the suction chamber. That is, the control valve for a variable displacement compressor senses the suction pressure Ps, and controls the flow rate of refrigerant introduced from the discharge chamber into the crankcase at the discharge pressure Pd, so as to hold the suction pressure Ps at a constant level.

To this end, the control valve for a variable displacement compressor is equipped with a pressure-sensing section for sensing the suction pressure Ps, and a valve section for causing a passage leading from the suction chamber to the crankcase to open and close according to the suction pressure Ps sensed by the pressure-sensing section. Further, a type of the control valve for a variable displacement compressor which is capable of freely externally setting a value of suction pressure Ps to be assumed, at the start of the variable displacement operation, is equipped with a solenoid that enables configuration of settings of the pressure-sensing section by external electric current.

By the way, conventional control valves for a variable displacement compressor which can be externally controlled include a type for control of a so-called clutchless variable displacement compressor configured such that an engine is directly connected to a rotational shaft without providing a solenoid clutch between the engine and the rotational shaft on which a wobble plate is fitted, for execution and inhibition of transmission of a driving force to the engine (see e.g. Japanese Unexamined Patent Publication (Kokai) No. 2000-110731 (Paragraph numbers [0010], [0044], and FIG. 1)).

This control valve comprises a valve section causing a passage communicating between a discharge chamber and a crankcase to be opened and closed, a solenoid for generating an electromagnetic force causing the valve section to operate in the closing direction, and a pressure-sensing section for causing the valve section to operate in the opening direction as suction pressure Ps becomes lower compared with the atmospheric pressure, which are arranged in this order. Therefore, when the solenoid is not energized, the valve section is in a fully open state, whereby pressure Pc in a crankcase can be held at a pressure close to discharge pressure Pd. This causes the wobble plate to become substantially at right angles to the rotational shaft, enabling the variable displacement compressor to operate with minimum capacity. Thus, the discharging capacity of refrigerant can be substantially reduced to approximately zero even when the engine is directly connected to the rotational shaft, which makes it possible to eliminate the solenoid clutch.

However, the conventional control valve for controlling a variable displacement compressor having no use for the solenoid clutch is configured such that the pressure-sensing section and the valve section are arranged with the solenoid interposed therebetween, and the suction pressure Ps is introduced to the pressure-sensing section which compares the suction pressure Ps and the atmospheric pressure, via the solenoid. This necessitates the solenoid in its entirety to be accommodated within a pressure chamber, and hence components of the solenoid need to be designed with considerations given to resistance to pressure.

To eliminate this inconvenience, the present applicant has proposed a control valve for a variable displacement compressor configured such that the plunger of a solenoid is divided into a first plunger and a second plunger, and a pressure-sensing member, such as a diaphragm or a bellows, is interposed therebetween for sensing suction pressure, whereby the valve lift of a valve section for controlling pressure in a crankcase is controlled by the second divisional plunger (Japanese Unexamined Patent Publication (Kokai) No. 2003-289581).

More specifically, for example, as shown in FIG. 8, the control valve 101 for a variable displacement compressor includes a body 102 that accommodates a valve section 110 and a solenoid 120, and a core 121, a first plunger 122, and a second plunger 123, which form the solenoid 120, are arranged in series within the body 102. Between the valve section 110 and the solenoid 120 within the body 102, there is disposed a holder 131 formed of a magnetic member in which the second plunger 123 is axially movably disposed.

The second plunger 123 has a non-magnetic guide 133, which is formed e.g. of polytetrafluoroethylene and has low sliding resistance, provided on the periphery thereof. The outer peripheral surface of the guide 133 is in sliding contact with the inner wall of the holder 131, whereby when the second plunger 123 is axially moved forward and backward, the guide 133 serves to guide the second plunger 123, while maintaining the same at a predetermined distance from the inner wall of the holder 131. The guide 133 has a circumferential part thereof cut open, thereby allowing suction pressure Ps to be introduced into a space formed on a lower end face of the second plunger 123.

Further, the second plunger 123 has an annular flange portion 124 assembled therewith such that it is fixed at an upper end location thereof, and a spring 161 is interposed between the flange portion 124 and an upper end face of the holder 131. A shaft 113 of the valve section 110, which is axially movably disposed within the body 102, has a lower end thereof in abutment with the second plunger 123 at an upper axial location of the second plunger 123.

The spring 161 urging the second plunger 123 upward is configured to have a larger spring force than that of the spring 162 urging the valve element 111 of the valve section 110 in the valve-closing direction. Therefore, when the solenoid 120 is not energized, the valve element 111 at the end of the shaft 113 is moved away from a valve seat 115 formed inside the body 102, and the valve section 110 is in its fully open state.

Below the second plunger 123, a pressure-sensing member 151 (diaphragm in the figure) constituting a pressure-sensing section is disposed. The pressure-sensing member 151 has its outer peripheral edge sandwiched by the holder 131 and a casing 141 of the solenoid 120 forming part of the body 102. Thus, part forming a pressure chamber of the control valve 101 for a variable displacement compressor extends up to a portion partitioned by the pressure-sensing member 151, and part lower than this portion receives the atmospheric pressure.

Within the casing 141, a solenoid coil 142 is disposed, and inside the solenoid coil 142 is disposed a sleeve 143. The sleeve 143 has a core 121 inserted into a lower portion thereof and fixed thereto. Between the core 121 and the pressure-sensing member 151 is disposed a first plunger 122 such that the first plunger 122 is axially movable within the sleeve 143. The shaft 126 disposed along the axis of the first plunger 122 has an upper end thereof inserted into the first plunger 122 for connection between the shaft 126 and the first plunger 122, with the lower end of the shaft 126 being supported by a bearing member 135 disposed within the body 102. Disposed between the bearing member 135 and a flange portion 127 fitted on the periphery of the shaft 126 is a spring 163 which urges the first plunger 122 toward the pressure-sensing member 151.

Due to the arrangement described above, the pressure-sensing member 151 fluidically separates a space having the first plunger 122 disposed therein and a space having the second plunger 123 disposed therein from each other. In other words, a section extending from the valve section 110 to a portion where the pressure-sensing member 151 is disposed, including the second plunger 123 which controls the valve lift of the valve section 110, is formed as a block to which pressure is applied, and the solenoid 120 exclusive of the second plunger 123 is not accommodated in the pressure chamber, allowing the same to be configured to be open to the atmosphere. Moreover, the second plunger 123 which controls the valve lift of the valve section 110 is urged in a direction away from the pressure-sensing member 151, so that when the solenoid is not energized, displacement of the pressure-sensing member 151 is not transmitted to the valve section 110, and at the same time the valve section 110 is held in its fully-open state, thereby enabling the variable displacement compressor to be controlled to the minimum displacement.

The first plunger 122 and the second plunger 123 formed by dividing the solenoid 120 are separated from each other when the solenoid is not energized, whereas when the solenoid is energized, they are attracted to each other to behave as one plunger. Therefore, when the solenoid 120 is energized, control is performed by the one plunger which is formed by the first plunger 122 and the second plunger 123 integrally attached to each other. Since the pressure-sensing member 151 is disposed between the first plunger 122 and the second plunger 123, opposed surfaces of the first plunger 122 and the second plunger 123 are formed to have a planar shape. As a result, when the solenoid is energized, a magnetic circuit is formed between the flat opposed surfaces whereby the first plunger 122 and the second plunger 123 are attracted to each other with the pressure-sensing member 151 being interposed therebetween.

In the arrangement described above, the magnetic circuit of the solenoid 120 surrounding the solenoid coil 142 is formed by the core 121, the first plunger 122, the second plunger 123, the holder 131, the casing 141, and the like. In this case, the magnetic circuit is formed in a state where the second plunger 123 is inserted into the holder 131, so that the attractive force of the solenoid 120 acts on the second plunger 123 in the radial direction thereof. Therefore, when the attractive force is large, there is a fear that the axial motion of the second plunger 123 is obstructed, or undesired vibrations of the second plunger 123 are caused by the attractive force. To overcome the inconveniences, conventionally, as shown in FIG. 8, the second plunger 123 is configured to have the non-magnetic guide 133 provided on the periphery thereof such that the guide 133 is in sliding contact with the inner wall of the holder 131, or a non-magnetic sleeve (not shown) is interposed between the second plunger 123 and the holder 131. However, the provision of such a non-magnetic member raises the problem that the number of component parts is increased to increase manufacturing costs.

Further, since the radial attractive force is applied to the second plunger 123 from the holder 131, an attractive force in the axial direction, which is the operating direction of the second plunger, is weakened, and especially when the first plunger 122 and the core 121 are away from each other, it is difficult to obtain sufficient attractive force characteristic.

Furthermore, in the arrangement in which the second plunger 123 slides on the holder 131 as described above, the problem of hysteresis becomes serious in which in spite of the control position being set to the same position, the valve element 111 is controlled to positions, different between when the valve element 111 is opened and when the valve element 111 is closed, e.g. due to the influence of a frictional force caused by the sliding motion.

SUMMARY OF THE INVENTION

The present invention has been made in view of these points, and an object thereof is to provide a control valve for a variable displacement compressor, particularly for a clutchless variable displacement compressor, including a plunger divided into separate members which is improved in the attractive force characteristic and reduced in manufacturing costs.

To solve the above problem, the present invention provides a control valve for a variable displacement compressor, which is mounted on the variable displacement compressor to control pressure within a gastightly-formed crankcase thereof to thereby change discharging capacity of refrigerant, comprising a body having a refrigerant passage formed therethrough, a valve section including a valve element moving to and away from a valve seat formed in the body so as to adjust a flow rate of refrigerant when part of refrigerant discharged from the variable displacement compressor is caused to flow into the crankcase, and a shaft configured to be axially slidably supported by the body and support the valve element such that the valve element can be caused to operate in unison therewith, and a solenoid including a core fixed within the body, a plunger for moving the valve element forward and backward within the body via the shaft so as to cause the valve element to open and close, and a solenoid coil for generating a magnetic circuit including the plunger and the core by electric current supplied from outside, wherein the plunger is formed by arranging a first plunger opposed to the core, and a second plunger to which an end of the shaft, opposite to the valve element, is connected, in series in an axial direction, the plunger being formed by arranging a pressure-sensing member for sensing suction pressure from a suction chamber, and a hollow cylindrical magnetic member for fixing the pressure-sensing member to the solenoid, between the first and second plungers, wherein the first plunger is configured to be urged in a direction away from the core, and support the second plunger in an axial direction when the solenoid is energized, and wherein the second plunger includes a small-diameter portion inserted into the magnetic member such that a predetermined space is formed therebetween, and a large-diameter portion radially outwardly extending from the small-diameter portion and having an opposed surface formed thereon which is axially opposed to an opposed surface of the magnetic member, the second plunger being urged in a direction away from the first plunger, while the magnetic circuit being formed via the opposed surfaces during energization of the solenoid.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

Hereinafter, embodiments of the present invention will be described in detail with reference to the drawings.

First Embodiment

Figure 1:
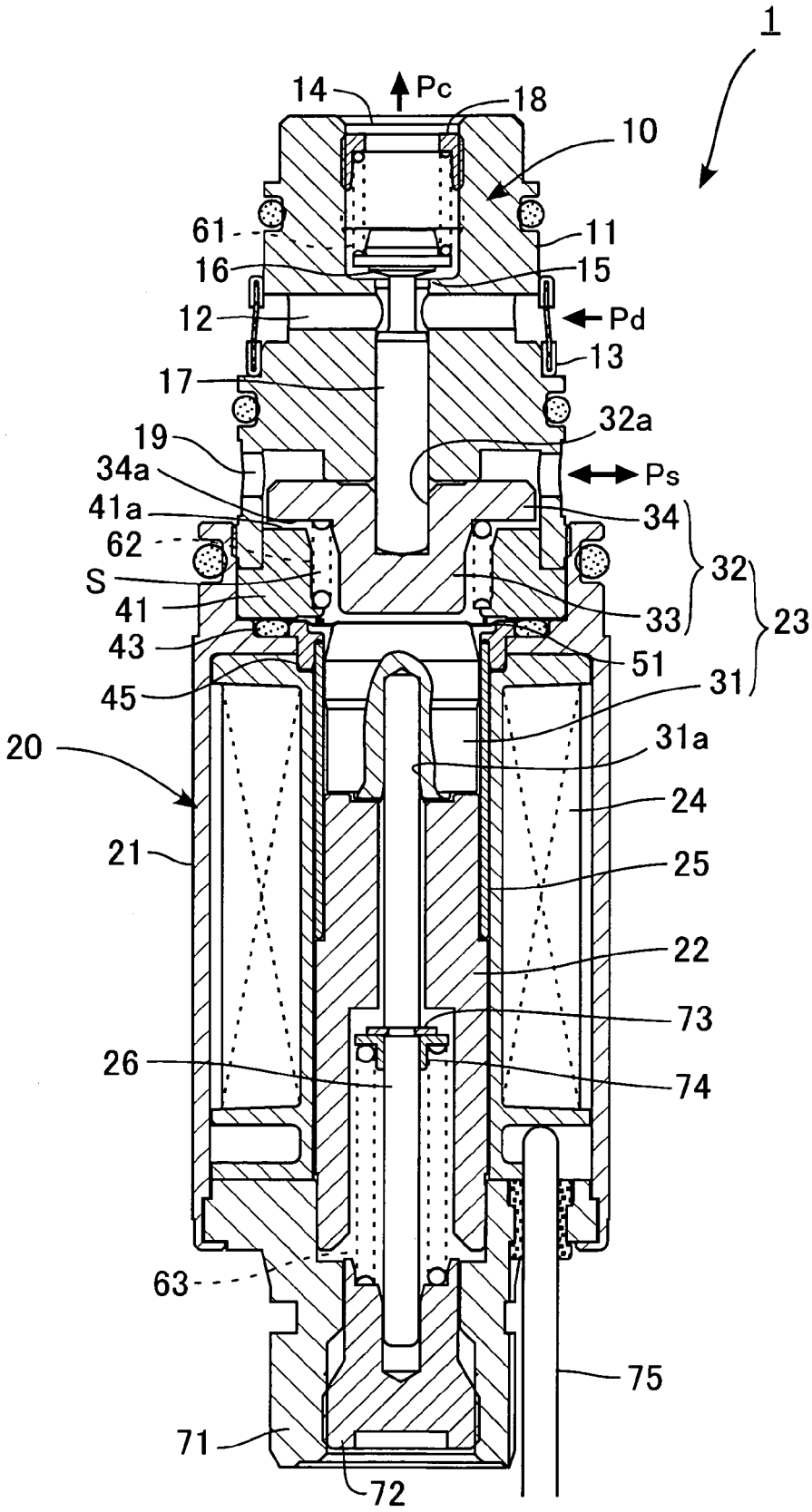
FIG. 1 is a cross-sectional view showing the arrangement of a control valve for a variable displacement compressor, according to a first embodiment.

FIG. 1 is cross-sectional view showing the arrangement of a control valve for a variable displacement compressor according to a first embodiment.

The control valve 1 for a variable displacement compressor is formed by integrally assembling a valve section 10 used for opening and closing a refrigerant passage for causing part of refrigerant discharged from the variable displacement compressor, not shown, to flow into a crankcase of the variable displacement compressor, and a solenoid 20 for controlling the flow rate of refrigerant passing through the valve section 10 by adjusting the amount of valve lift of the valve section 10.

The valve section 10 includes a body 11 formed with a side opening which communicates with a discharge chamber of the variable displacement compressor to form a port 12 for receiving discharge pressure Pd from the discharge chamber. The port 12 has a strainer 13 fixed to the periphery thereof. The port 12 for receiving the discharge pressure Pd communicates with a port 14 opening in the top of the body 11, via a refrigerant passage through the inside of the body 11. The port 14 communicates with the crankcase of the variable displacement compressor to guide controlled pressure Pc out into the crankcase.

In the refrigerant passage communicating between the port 12 and the port 14, a valve seat 15 is integrally formed with the body 11. In opposed relation to a side of the valve seat 15, from which the pressure Pc is guided out, a valve element 16 is axially disposed in a manner movable to and away from the valve seat 15. The valve element 16 is integrally formed with a pressure-sensing piston 17 (shaft) which extends downward as viewed in the figure, through a valve hole such that it is axially movably held by the body 11. The discharge pressure Pd from the discharge chamber is guided into a small-diameter portion of the pressure-sensing piston 17 for connecting between the valve element 16 and the pressure-sensing piston 17. The outer diameter of the pressure-sensing piston 17 is set to be equal to the inner diameter of the valve hole forming the valve seat 15 such that the pressure-receiving area of the valve element 16 is equal to that of the pressure-sensing piston 17. As a result, a force with which the discharge pressure Pd acts on the valve element 16 in the upward direction as viewed in the figure is cancelled by a force acting on the pressure-sensing piston 17 in the downward direction as viewed in the figure, such that the control of the valve section 10 is not adversely affected by the high discharge pressure Pd.

The valve element 16 is urged by a spring 61 in the valve-closing direction, and load on the spring 61 is adjusted by an adjustment screw 18 screwed into the port 14.

Further, a port 19 communicating with a suction chamber of the variable displacement compressor to receive suction pressure Ps is formed in a lower portion of the body as viewed in the figure.

The solenoid 20 includes a core 22 rigidly fixed to the inside of a casing 21 thereof, a plunger 23 for moving the valve element 16 to and away from the valve seat 15 via the pressure-sensing piston 17 so as to cause the valve section 10 to open and close, and a solenoid coil 24 for generating a magnetic circuit including the core 22 and the plunger 23 by electric current supplied from outside. The plunger 23 is divided into a first plunger 31 and a second plunger 32, both referred to hereinafter.

Disposed between the body 11 of the valve section 10 and the casing 21 of the solenoid 20 is a holder 41 (magnetic member) formed by a hollow cylindrical magnetic material, and the second plunger 32 is partially inserted into the holder 41 such that it is disposed in an axially movable manner.

More specifically, the second plunger 32 is in the form of a bottomed and stepped hollow cylinder, and includes a small-diameter portion 33 inserted into the holder 41 with a predetermined space S interposed between the same and the holder 41, and a large-diameter portion 34 radially outwardly extending from one end of the small-diameter portion 33 in a manner forming a flanged portion. The small-diameter portion 33 has an opposed surface opposed to an end face of the first plunger 31 via a diaphragm 51 (pressure-sensing member), while the large-diameter portion 34 has an opposed surface 34*a* formed at the flanged portion thereof such that it is axially opposed to an end face 41*a* (upper end face as viewed in the figure) of the holder 41. Further, in the space S described above, a spring 62 (elastic member) formed of a non-magnetic material (stainless or the like) for urging the second plunger 32 in the valve-opening direction is interposed between the opposed surface 34*a* of the second plunger 32 and a stepped surface formed at a lower portion of the holder 41. The above pressure-sensing piston 17, which is axially slidably supported by the body 11 with almost no clearance between the same and the body 11, has a lower end thereof slidably inserted into an insertion hole 32*a* formed at an axial location of the large-diameter portion 34 of the second plunger 32, for connection to the insertion hole 32*a*. However, the second plunger 32 operates in unison with the pressure-sensing piston 17, or operates by being guided along the pressure-sensing piston 17, without being removed from the pressure-sensing piston 17, due to the relationship between the depth of the insertion hole 32*a*, balance of the urging forces of the springs 61 and 62, etc.

The spring 62 urging the second plunger 32 upward as viewed in the figure has a larger spring force than that of the spring 61 urging the valve element 16 in the valve-closing direction. Therefore, when the solenoid 20 is not energized, the second plunger 32 can push the pressure-sensing piston 17 upward until the pressure-sensing piston 17 is brought into abutment with the ceiling of a chamber communicating with the port 19, and hold the valve element 16 in its fully open position.

The diaphragm 51 forming a pressure-sensing section below the second plunger 32 as viewed in the figure has its outer peripheral edge sandwiched by the holder 41 and the casing 21 of the solenoid, and is sealed by a packing 43. The sandwiching of the diaphragm 51 by the holder 41 and the casing 21 of the solenoid 20 is realized by rigidly fixing an upper end edge of the casing 21 as viewed in the figure to a lower end of the body 11 as viewed in the figure, with the holder 41 held therebetween, by caulking. Thus, part forming a pressure chamber of the control valve 1 for the variable displacement compressor extends up to a portion partitioned by the diaphragm 51, and part lower than this portion receives the atmospheric pressure.

In the present embodiment, the diaphragm 51 is formed e.g. of one piece of polyimide film. However, by using a plurality of pieces thereof overlaid one upon another as required, it is possible to increase resistance to breakage which might be caused by repeated collision of the first plunger 31. It should be noted that although the diaphragm 51 may be made of a resin material, such as polyimide, as described above, it may be formed of a metallic material, such as beryllium copper or stainless steel.

The first plunger 31 has a cylindrical shape with a tapered portion formed at an upper end thereof, and is axially movably disposed within a hollow cylindrical sleeve 25 rigidly fixed to an upper portion of the solenoid 20. A stepped hollow cylindrical core 22 having a diametrically expanded portion at a lower portion thereof as viewed in the figure is inserted into a lower opening of the sleeve 25, as viewed in the figure, for being rigidly fixed thereto.

A shaft 26, which is disposed at an axial location of the core 22 in a manner extending therethrough, has an upper end thereof, as viewed in the figure, slidably inserted into an insertion hole 31*a* formed at an axial location of the first plunger 31 in a manner opening downward, for connection to the insertion hole 32*a*. The shaft 26 is configured such that it can support the first plunger 31 from below. Further, a lower end of the shaft 26 is supported by a bearing recessed in an adjustment screw 72 screwed into a handle 71 closing an opening end of the casing 21. A stop ring 73 is fitted on an intermediate portion of the shaft 26, and a spring-receiving portion 74 is formed such that the upward movement thereof as viewed in the figure is restricted by the stop ring 73. Between the spring-receiving portion 74 and the adjustment screw 72 is disposed a spring 63. The first plunger 31 is urged by the spring 63 via the shaft 26 in a direction in which the first plunger 31 is moved away from the core 22. Further, load of the spring 63 can be changed by adjusting the screwing amount of the adjustment screw 72, whereby it is possible to adjust a setting value set to the control valve 1.

A collar 45 formed by a non-magnetic material is mounted on an upper end of the sleeve 25 as viewed in the figure. The collar 45 separates the casing 21 and the first plunger 31 from each other such that almost no attractive force is generated therebetween, and determines an effective pressure-receiving diameter of the diaphragm 51 receiving the suction pressure Ps.

The solenoid coil 24 is disposed around the outer peripheries of the sleeve 25 and the core 22. The solenoid coil 24 is surrounded by the casing 21 formed of a magnetic material, and supplied with control current via a harness 75.

In the arrangement described above, a body of the whole control valve 1 for the variable displacement compressor is formed by the body 11 of the valve section 10, the casing 21 of the solenoid 20, and the handle 71. The magnetic circuit of the solenoid 20 surrounding the solenoid coil 24 is formed by the core 22, the first plunger 31, the second plunger 32, the holder 41, the casing 21, and so forth. In other words, when the solenoid 20 is energized, the magnetic circuit is formed via the opposed surface 34*a* opposed to the operating direction (axial direction) of the second plunger 32.

The control valve 1 illustrated in the figure is in a state in which the solenoid 20 is not energized and the suction pressure Ps is high, that is, a state in which the air conditioner is not in operation. Since the suction pressure Ps is high, the first plunger 31 in abutment with the diaphragm 51 is displaced downward as viewed in the figure against the load of the spring 63, to be brought into abutment with the core 22. On the other hand, the second plunger 32 is urged upward as viewed in the figure, by the spring 62 such that it is moved away from the first plunger 31, and hence the second plunger 32 urges the valve element 16 toward its fully open position via the pressure-sensing piston 17. Therefore, even when the rotational shaft of the variable displacement compressor is being driven for rotation by the engine in the above state, the variable displacement compressor is operated with the minimum displacement.

Now, when the maximum control current is supplied to the solenoid coil 24 of the solenoid 20, as in the case of the automotive air conditioner having been started, the first plunger 31 is pressed downward as viewed in the figure by the high suction pressure Ps to be brought into abutment with the core 22, so that even if the first plunger 31 is attracted by the core 22, it remains in the same position. Therefore, in this case, the first plunger 31 and the core 22 behave as if they were a fixed core, so that the first plunger 31 attracts the second plunger 32 against the urging force of the spring 62. The second plunger 32 is attracted and attached to the first plunger 31, whereby the second plunger 32 is moved downward as viewed in the figure. This allows the spring 61 to push the valve element 16 downward, thereby causing the valve element 16 to be seated on the valve seat 15, to fully close the valve section 10. This blocks off the passage extending from the discharge chamber to the crankcase, so that the variable displacement compressor is promptly shifted into the operation with the maximum capacity.

When the variable displacement compressor continues to operate with the maximum capacity to make the suction pressure Ps from the suction chamber low enough, the diaphragm 51 senses the suction pressure Ps and attempts to move upward as viewed in the figure. At this time, if the control current supplied to the solenoid coil 24 of the solenoid 20 is decreased according to the set temperature of the air conditioner, the second plunger 32 and the first plunger 31 in attracted state move in unison upward as viewed in the figure to a position where the suction pressure Ps, the loads of the springs 61, 62, and 63, and the attractive force of the solenoid 20 are balanced. This causes the valve element 16 to be pushed upward by the second plunger 32 to move away the valve seat 15, thereby being set to a predetermined valve lift. Therefore, refrigerant having discharge pressure Pd is introduced into the crankcase at a flow rate controlled to a value dependent on the valve lift, whereby the variable displacement compressor is shifted to operation with the displacement corresponding to the control current.

When the control current supplied to the solenoid coil 24 of the solenoid 20 is constant, the diaphragm 51 senses the suction pressure Ps to thereby control the valve lift of the valve section 10. For example, when the refrigerating load increases to make the suction pressure Ps high, the first plunger 31 is displaced downward as viewed in the figure, so that the valve element 16 is also moved downward to decrease the valve lift of the valve section 10, causing the variable displacement compressor to operate in a direction of increasing the displacement. On the other hand, when the refrigerating load decreases to make the suction pressure Ps low, the first plunger 31 is displaced upward as viewed in the figure to increase the valve lift of the valve section 10, causing the variable displacement compressor to operate in a direction of decreasing the discharge capacity. Thus, the control valve controls the discharge capacity of the variable displacement compressor such that the suction pressure Ps is made constant.

As described hereinabove, in the control valve 1 for the variable displacement compressor, according to the present embodiment, since the predetermined space S is formed between the holder 41 and the small-diameter portion 33 of the second plunger 32 inserted into the holder 41, it is possible to reduce the attractive force acting in the radial direction of the second plunger 32 during energization of the solenoid 20. In the meanwhile, the opposed surfaces 34*a* and 41*a* axially opposed to each other are arranged between the large-diameter portion 34 of the second plunger 32 and the holder 41, whereby the control valve 1 is configured such that the magnetic circuit is formed via the opposed surfaces during energization of the solenoid 20. This makes it possible to increase the attractive force in the operating direction of the second plunger 32. As a result, the attractive force in the valve-closing direction of the valve element 16 connected to the second plunger 32 can be relatively increased during energization of the solenoid 20. This enhances the attractive force characteristic of the whole control valve.

Figure 3:
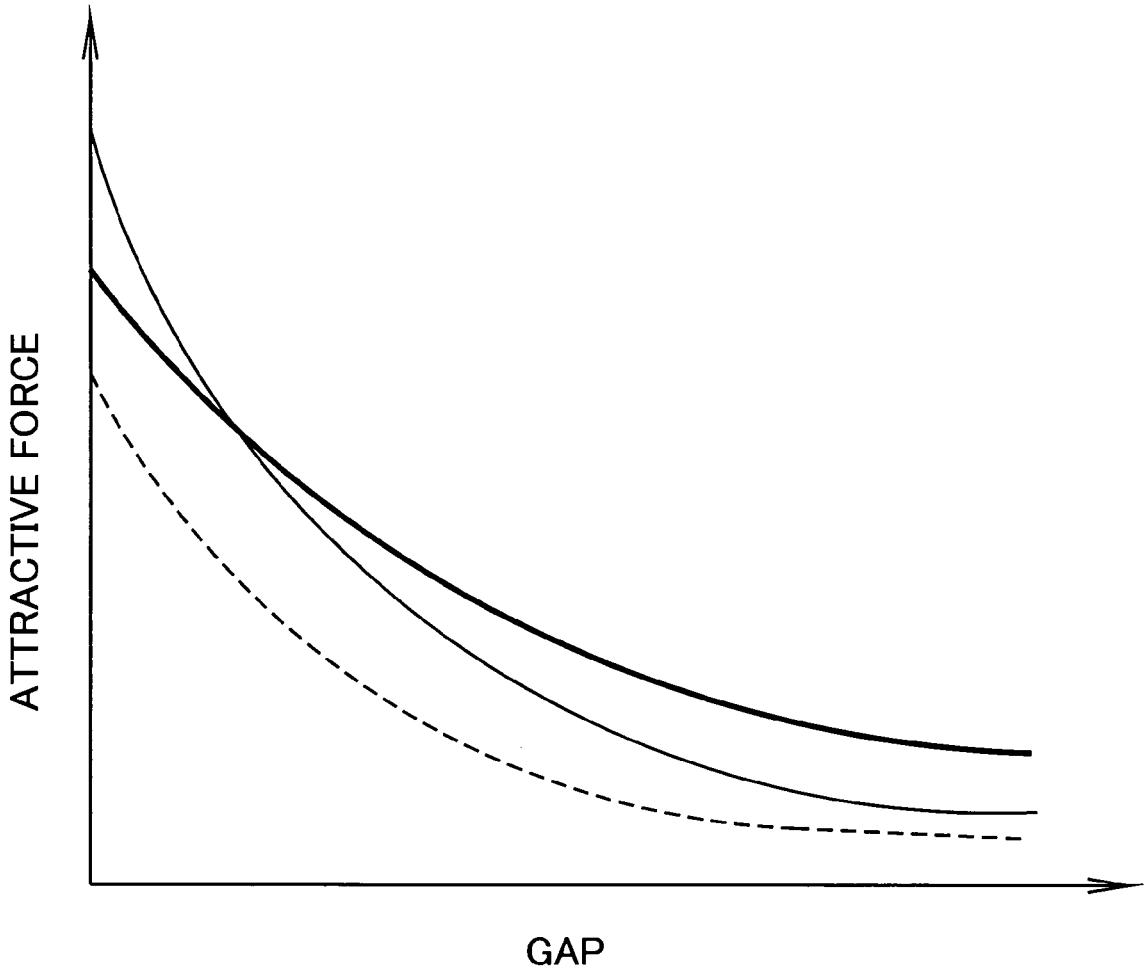
FIG. 3 is a graph showing respective attractive force characteristics of control valves for a variable displacement compressor.

FIG. 3 is a graph showing the attractive force characteristic of the control valve. In the figure, the horizontal axis represents the magnitude of a gap in the magnetic circuit of the control valve, and the vertical axis represents the magnitude of the attractive force of the solenoid in the axial direction. In the figure, a dotted line indicates the attractive force characteristic of the control valve 101 for a variable displacement compressor, of the type shown in FIG. 8, in which the second plunger 123 receives attractive force in the radial direction, and a thin solid line indicates the attractive force characteristic of the control valve 1 of the type shown in FIG. 1, in which the second plunger 32 mainly receives the attractive force in the axial direction. This graph shows that the attractive force characteristic of the whole control valve 1 is enhanced by the arrangement of the present embodiment.

As described above, since the attractive force in the valve-closing direction of the valve element 16 is increased, it is possible to reduce the spring force of the spring 61 assistingly urging the valve element 16 in the valve-closing direction. As a result, when the solenoid 20 is not energized, inversely, it becomes easy to fully open the valve section 10, which makes it easy to shift the variable displacement compressor to the minimum operation mode.

Further, since the second plunger 32 is configured such that it can operate in a state connected to the pressure-sensing piston 17 axially slidably supported by the body 11, the second plunger 32 can be caused to operate by axially moving the same without guiding the second plunger 32 itself. This makes it unnecessary to additionally incorporate component parts, such as a guiding member made of a non-magnetic material for guiding the second plunger 32, a sleeve, and so forth, thereby enabling reduction of costs through reduction of the number of component parts.

Furthermore, since the space S is formed between the second plunger 32 and the holder 41 to thereby inhibit the second plunger 32 itself from sliding within the body 11, it is possible to reduce hysteresis of the valve element 16 with respect to its control position.

Further, since the spring 62 is disposed in the above space S, it is possible to make effective use of the empty space.

Second Embodiment

Figure 2:
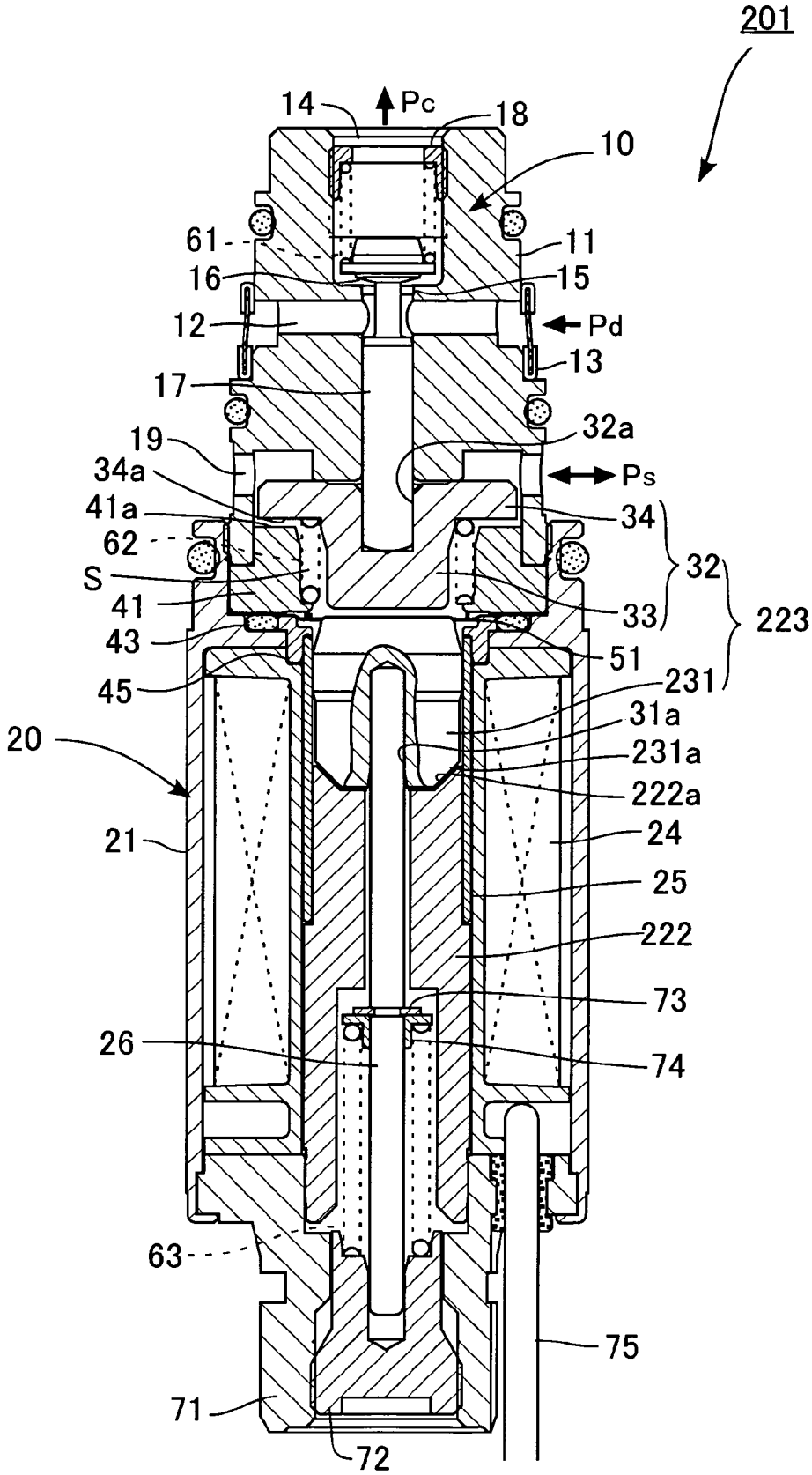
FIG. 2 is a cross-sectional view showing the arrangement of a control valve for a variable displacement compressor, according to a second embodiment.

Next, a description will be given of a second embodiment of the present invention. It should be noted that a control valve for a variable displacement compressor, according to the present embodiment, is configured similarly to the above-described first embodiment, except that the opposed surfaces of a first plunger and a core are different in configuration, and hence identical component parts are designated by identical reference numerals, and description thereof is omitted. FIG. 2 is a cross-sectional view showing the arrangement of the control valve for a variable displacement compressor, according to the present embodiment.

As shown in FIG. 2, in the control valve 201 for a variable displacement compressor, according to the present embodiment, the opposed surfaces 231*a* and 222*a* of the first plunger 231 formed by dividing a plunger 223 and the core 222 are formed to have respective tapered surfaces having complementary shapes to each other.

More specifically, the opposed end faces of the first plunger 31 and the core 22 of the control valve 1 according to the first embodiment are configured to have planar shapes approximately parallel with each other. In contrast, in the control valve 201 for a variable displacement compressor, according to the present embodiment, the opposed surface 231*a* of the first plunger 231, opposed to the core 222, is formed as a tapered surface protruding to have a conical shape except for a central portion thereof, while the opposed surface 222*a* of the core 222, opposed to the first plunger 231, is formed as a tapered surface which appears to be formed by cutting off a conical portion of the core except for a central portion thereof, and has a conical shape complementary to the shape of the opposed surface 231*a*. As described above, since the opposed surfaces of the first plunger 231 and the core 222 are formed to have respective tapered shapes and be sloped, there occurs a phenomenon of so-called magnetic leakage, in which a component of the attracting force in the radial direction at right angles to the axial direction as the proper attracting direction is generated in a magnetic circuit. This reduces an attractive force generated when the first plunger 231 and the core 222 are close to each other. Inversely, when the first plunger 231 and the core 222 are distant from each other, although a distance by which the first plunger 231 and the core 222 distant spaced from each other is the same, the shortest distance between the opposed surfaces 231*a* and 222*a* is reduced, which makes it possible to practically reduce the magnetic gap. As a result, the attractive force acting between the opposed surfaces 231*a* and 222*a* of the first plunger 231 and the core 222 can be made higher than the attractive force acting between the parallel planes. This makes it possible to further enhance the attractive force acting between the first plunger 231 and the core 222 when they are distant from each other.

In the FIG. 3 graph, a thick solid line indicates the attractive force characteristic of the control valve 201 according to the present embodiment. As shown in the figure, when the gap between the first plunger 231 and the core 222 is small, that is, when the first plunger 231 and the core 222 are close to each other, the attractive force is made smaller than in the first embodiment. However, similarly to the first embodiment, the opposed surfaces 34*a* and 41*a* axially opposed to each other are formed on the large-diameter portion 34 of the second plunger 32 and the holder 41 to thereby increase the attractive force in the axial direction, so that it is possible to obtain a larger attractive force than in the control valve 101 for a variable displacement compressor, shown in FIG. 8.

On the other hand, when the distance between the first plunger 231 and the core 222 is large, the attractive force acting therebetween is larger than in the first embodiment.

Figure 8:
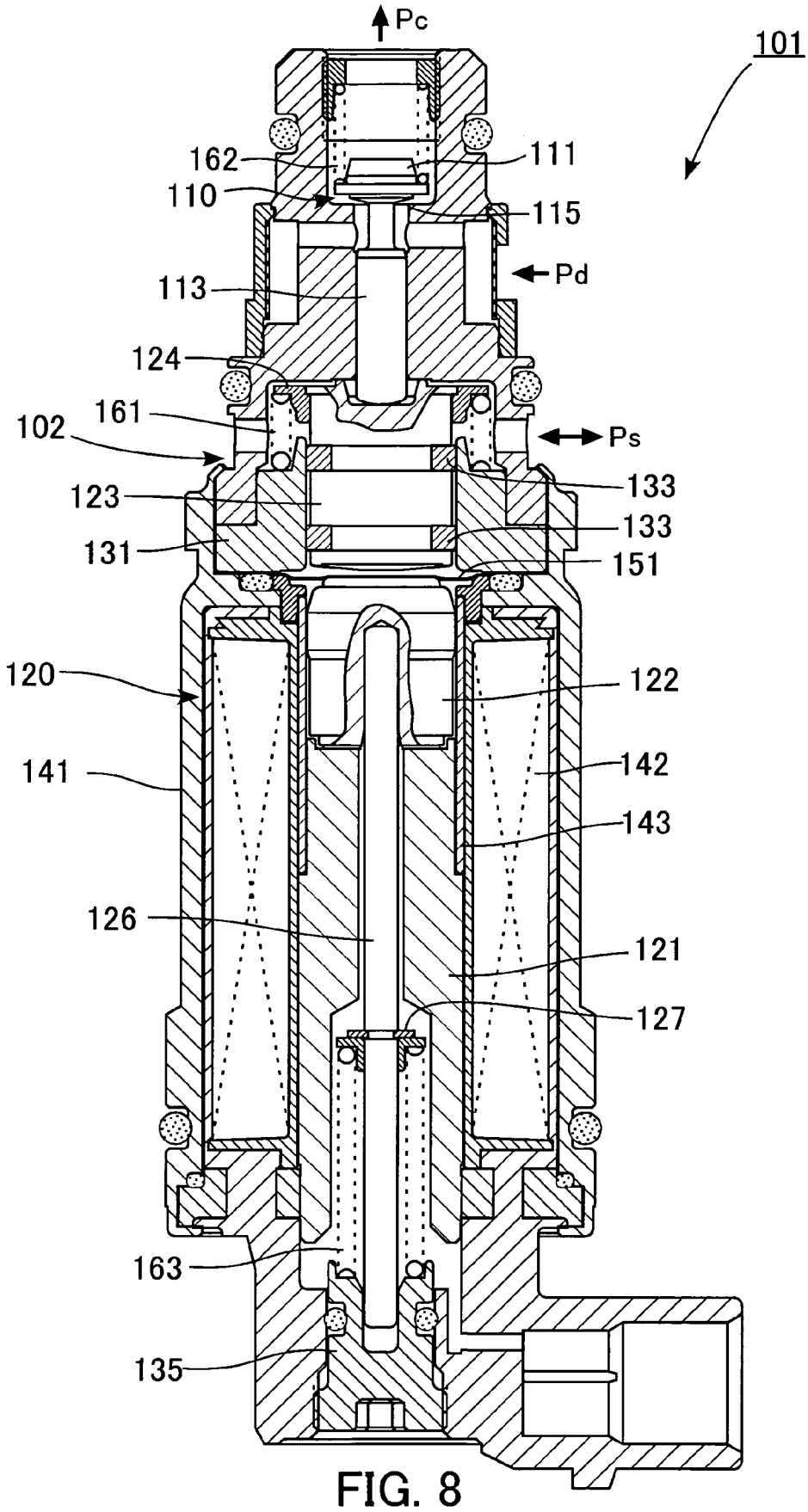
FIG. 8 is a cross-sectional view showing another example of the arrangement of a control valve for a variable displacement compressor.

According to the present embodiment, also when the first plunger 231 and the core 222 are close to each other, it is possible to obtain a sufficiently larger attractive force than in the control valve 101 of the type shown in FIG. 8, and at the same time even when the distance between the first plunger 231 and the core 222 is large, a large attractive force can be obtained, so that it is possible to obtain a larger and more stable attractive force in total.

Third Embodiment

Figure 4:
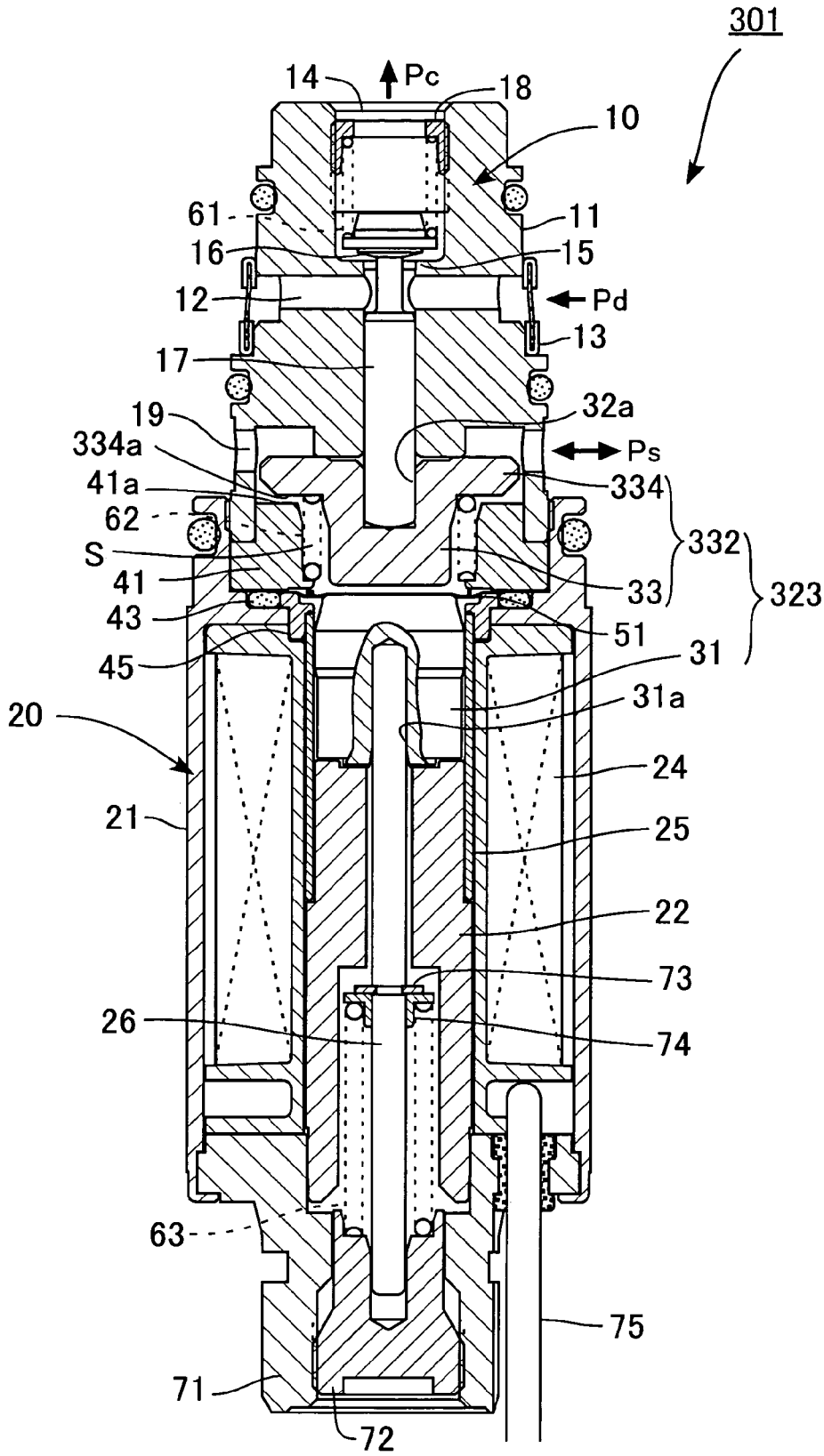
FIG. 4 is a cross-sectional view showing the arrangement of a control valve for a variable displacement compressor, according to a third embodiment.

Next, a description will be given of a third embodiment of the present invention. It should be noted that a control valve for a variable displacement compressor, according to the present embodiment, is configured similarly to the above-described first embodiment, except that the large-diameter portion of a second plunger is different in configuration, and hence identical component parts are designated by identical reference numerals, and description thereof is omitted. FIG. 4 is a cross-sectional view showing the arrangement of the control valve for a variable displacement compressor, according to the present embodiment.

As shown in FIG. 4, in the control valve 301 for a variable displacement compressor, according to the present embodiment, the shape of the large-diameter portion 334 of the second plunger 332 formed by dividing a plunger 323 is different from that of the large-diameter portion in the first embodiment shown in FIG. 1.

More specifically, a peripheral potion of the large-diameter portion 334, opposed to the end face 41*a* of the holder 41, is partially cut off such that a peripheral area of an opposed surface 334*a* of the large-diameter portion 334 has a tapered shape sloped in a direction away from the holder 41.

The magnetic gap between the second plunger 332 and the holder 41 is increased by the above configuration, whereby the attractive force can be made lower than in the case of the first embodiment. In other words, although the attractive force characteristic could be enhanced by the first embodiment, if the opposed surfaces of the second plunger 332 and the holder 41 are designed as described above, it is possible to control the attractive force to a desired value.

Fourth Embodiment

Figure 5:
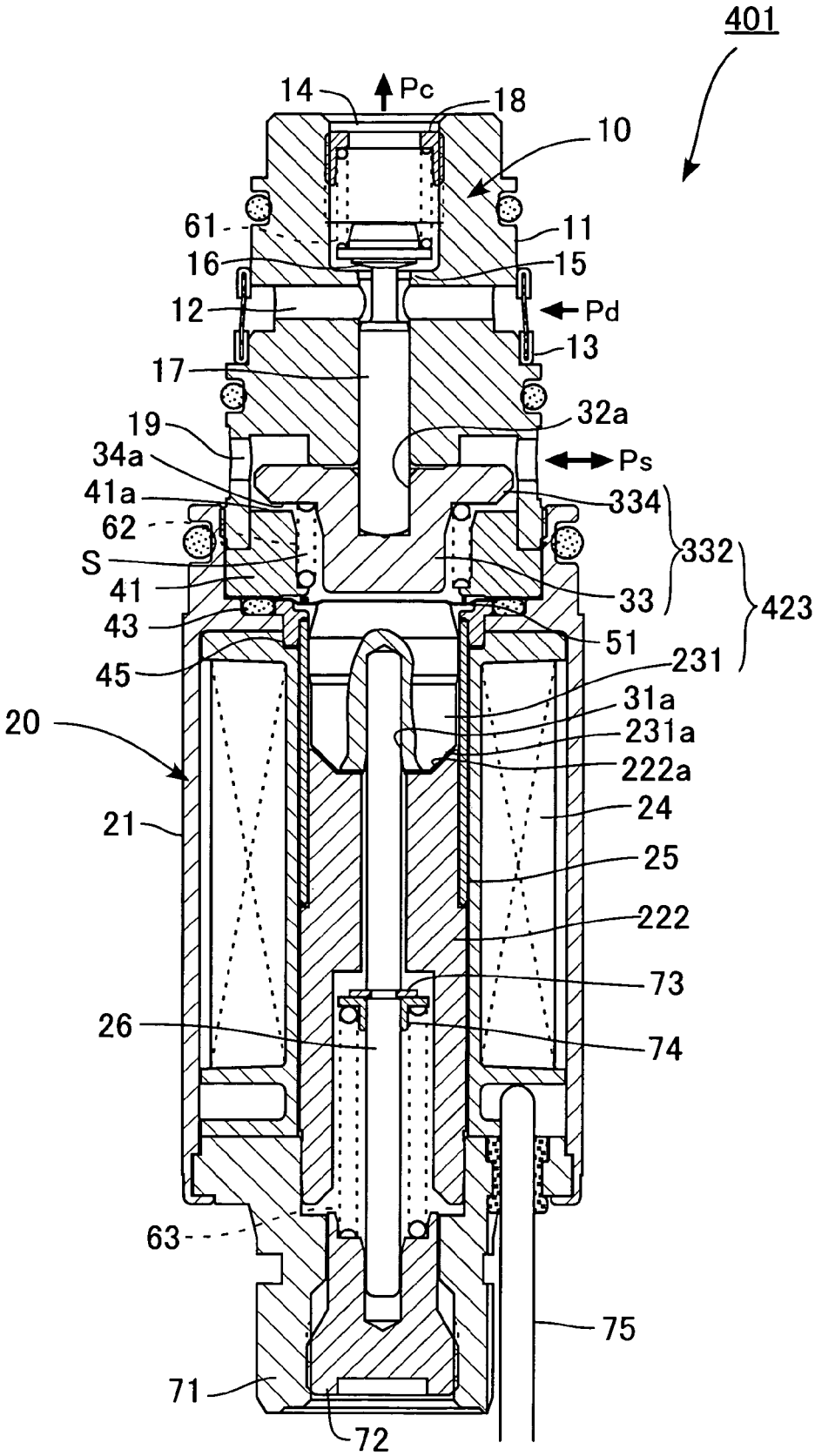
FIG. 5 is a cross-sectional view showing the arrangement of a control valve for a variable displacement compressor, according to a fourth embodiment.

Next, a description will be given of a fourth embodiment of the present invention. It should be noted that a control valve for a variable displacement compressor, according to the present embodiment, is configured similarly to the above-described third embodiment, except that the opposed surfaces of a first plunger and a core are different in configuration, and hence identical component parts are designated by identical reference numerals, and description thereof is omitted. FIG. 5 is a cross-sectional view showing the arrangement of the control valve for a variable displacement compressor, according to the present embodiment.

As shown in FIG. 5, in contrast to the above-described third embodiment, in the control valve 401 for a variable displacement compressor, respective opposed surfaces 231*a* and 222*a* of the first plunger 231 of a plunger 423 and the core 222 are formed as tapered surfaces having complementary shapes to each other, similarly to the second embodiment.

As a result, a large attractive force can be obtained also when the distance between the first plunger 231 and the core 222 is large, so that it is possible to obtain a larger and more stable attractive force in total.

Fifth Embodiment

Figure 6:
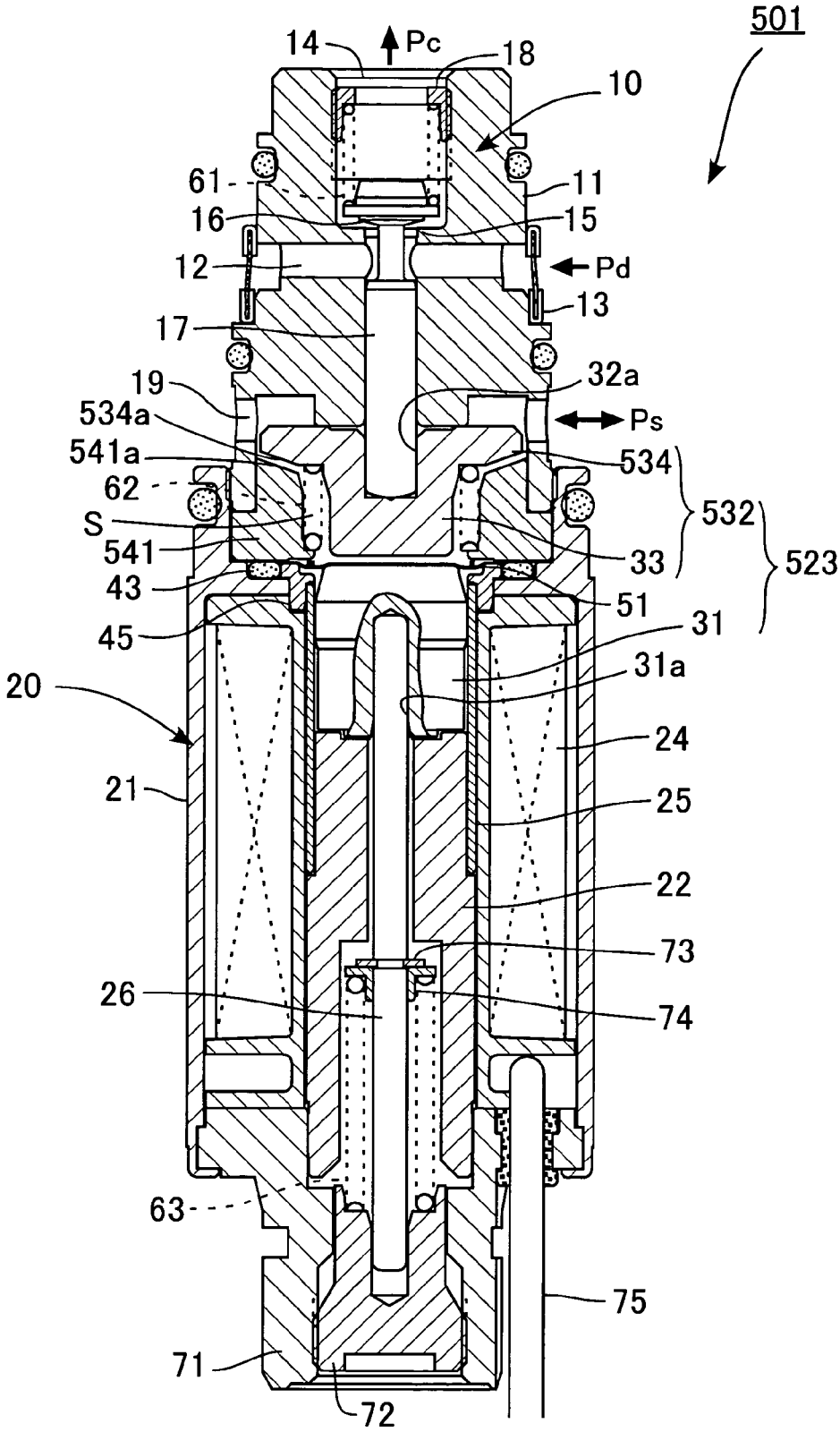
FIG. 6 is a cross-sectional view showing the arrangement of a control valve for a variable displacement compressor, according to a fifth embodiment.

Next, a description will be given of a fifth embodiment of the present invention. It should be noted that a control valve for a variable displacement compressor, according to the present embodiment, is configured similarly to the above-described first embodiment, except that the large-diameter portion of a second plunger and a holder are different in configuration, and hence identical component parts are designated by identical reference numerals, and description thereof is omitted. FIG. 6 is a cross-sectional view showing the arrangement of the control valve for a variable displacement compressor, according to the present embodiment.

As shown in FIG. 6, in the control valve 501 for a variable displacement compressor, according to the present embodiment, a large-diameter portion 534 of a second plunger 532 formed by dividing a plunger 523, and a holder 541 opposed to the large-diameter portion 534 are different in shape from those in the first embodiment shown in FIG. 1.

More specifically, an opposed surface 534*a* of the large-diameter portion 534, opposed to the holder 541, is formed as a tapered surface sloped toward an outer periphery thereof in a direction away from the holder 541, and an opposed surface 541*a* of the holder 541, opposed to the large-diameter portion 534, is formed as a tapered surface having a complementary shape to the opposed surface 534*a* of the large-diameter portion 534, and sloped such that the opposed surface 541*a* is substantially in parallel with the opposed surface 534*a*. As described above, since the opposed surfaces of the large-diameter portion 534 of the second plunger 532 and the holder 541 are formed to have respective tapered shapes and be sloped, there occurs a phenomenon of so-called magnetic leakage, in which a component of the attractive force in the radial direction at right angles to the axial direction as the proper attracting direction, is generated in a magnetic circuit. This reduces an attractive force generated when the large-diameter portion 534 of the second plunger 532 and the holder 541 are close to each other. Inversely, when the large-diameter portion 534 and the holder 541 are distant from each other, although an axial distance by which the large-diameter portion 534 of the second plunger 532 and the holder 541 are spaced from each other is the same, the shortest distance between the opposed surfaces 534*a* and 541*a* is reduced, and hence the magnetic gap can be practically reduced. As a result, an attractive force acting between the opposed surfaces 534*a* and 541*a* can be made higher than an attractive force acting between the planes in parallel with each other.

Sixth Embodiment

Figure 7:
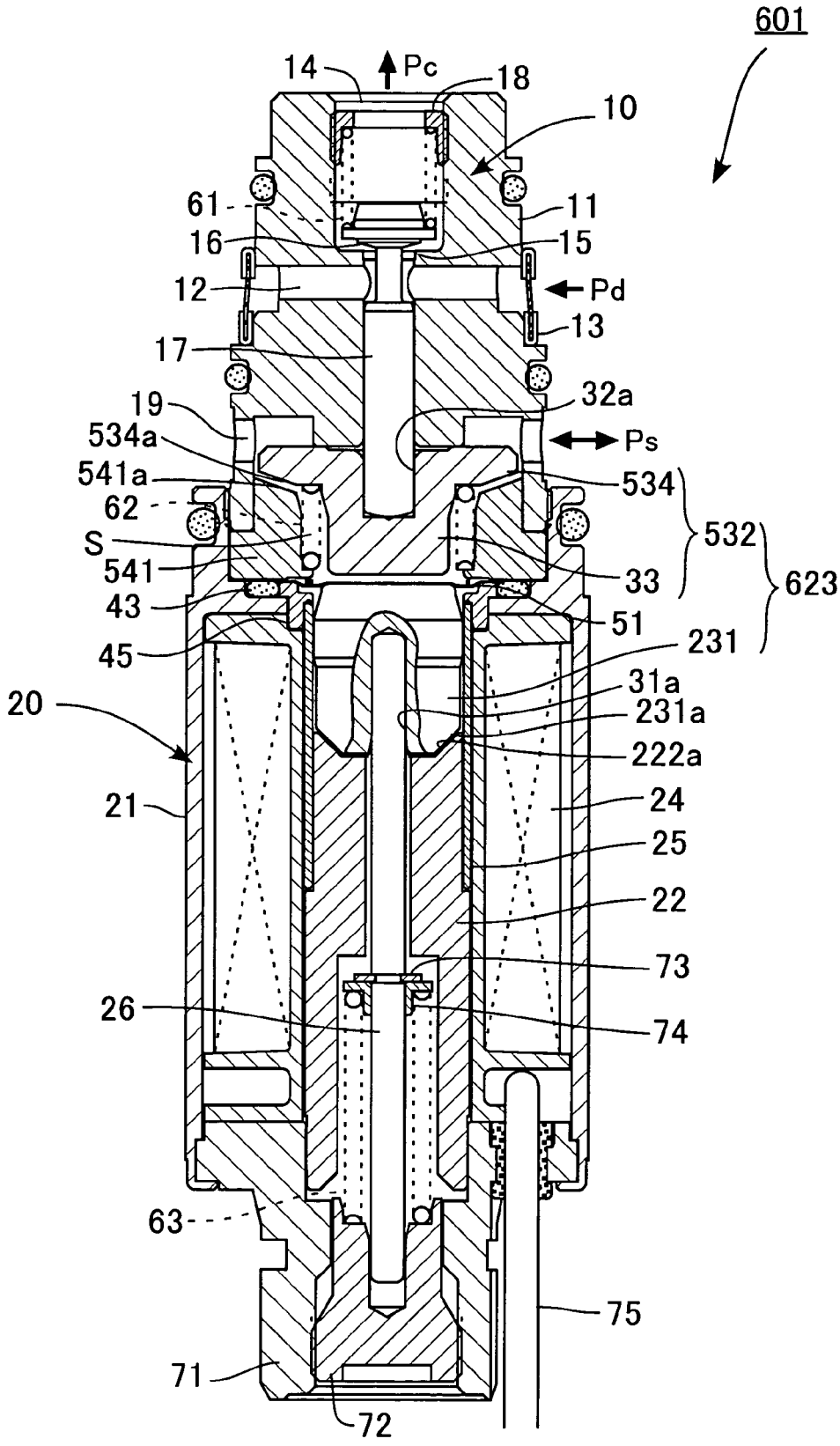
FIG. 7 is a cross-sectional view showing the arrangement of a control valve for a variable displacement compressor, according to a sixth embodiment.

Next, a description will be given of a sixth embodiment of the present invention. It should be noted that a control valve for a variable displacement compressor, according to the present embodiment, is configured similarly to the above-described fifth embodiment, except that the opposed surfaces of the first plunger and the core are different in configuration, and hence identical component parts are designated by identical reference numerals, and description thereof is omitted. FIG. 7 is a cross-sectional view showing the arrangement of the control valve for a variable displacement compressor, according to the present embodiment.

As shown in FIG. 7, in contrast to the above fifth embodiment, in the control valve 601 for a variable displacement compressor, respective opposed surfaces 231*a* and 222*a* of the first plunger 231 of a plunger 623 and the core 222 and formed as tapered surfaces having complementary shapes to each other, similarly to the second embodiment.

As a result, since a large attractive force can be obtained also when the distance between the first plunger 231 and the core 222 is large, it is possible to obtain a larger and more stable attractive force in total.

Although the preferred embodiments of the present invention have been described heretofore, the present invention is by no means limited to any specific one of the above-described embodiments, but various modifications and alterations can be made thereto without departing the spirit and scope of the present invention.

For example, although in the illustrated arrangements of the control valves for a variable displacement compressor according to the respective embodiments, the diaphragm is employed as a pressure-sensing member, this is not limitative, but other types of pressure-sensing member, such as a bellows or the like, may be employed.

Further, although the above-described embodiments are configured such that the holder as a magnetic member is formed separately from the casing of the solenoid with the diaphragm interposed between the holder and the casing, this is not limitative, but the holder may be integrally formed with the casing (yoke) of the solenoid as part of the casing, and a pressure-sensing member, such as a diaphragm or the like, may be disposed at a predetermined location on an inner peripheral surface of the casing. This disposition can be realized e.g. by rigidly fixing the periphery of the diaphragm or the like to the casing e.g. by welding.

Further, although in the above-described embodiments, the valve element 16 and the pressure-sensing piston 17 are integrally formed with each other, the valve element may be configured e.g. by a ball valve such that the ball valve can be supported by a shaft in place of the pressure-sensing piston 17.

Furthermore, although in the above-described embodiments, there are shown examples of tapered shapes of tapered surfaces formed on the first plunger and the core or on the second plunger and the holder, the tapered shapes are not limited to the above described shapes, but the angles and directions of the tapered shapes, and the starting points of tapers can be changed as required.

The control valve for a variable displacement compressor, according to the present invention, is configured such that the second plunger comprises the small-diameter portion and the large-diameter portion, and the attractive force applied in the radial direction of the second plunger during energization of the solenoid is reduced, while the attractive force applied in the operating direction of the second plunger, i.e. in the valve-closing direction is increased. Therefore, the attractive force characteristic of the control valve for a variable displacement compressor is enhanced. As a result, when the solenoid is not energized, the large attractive force is cancelled, so that inversely the valve section can be fully opened with ease, which makes it easy to promptly shift the variable displacement compressor to the minimum operation mode.

Further, the second plunger is configured to be capable of operating in the state connected to the shaft sliding within the body. This makes it unnecessary to additionally incorporate component parts, such as a guiding member made of a non-magnetic material for guiding the second plunger, a sleeve, and so forth, thereby enabling reduction of costs through reduction of the number of component parts.

Furthermore, the space is formed between the second plunger and the magnetic member to thereby inhibit the second plunger itself from sliding on the body 11, it is possible to reduce hysteresis of the valve element with respect to its control position.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A control valve for a variable displacement compressor, which is mounted on the variable displacement compressor to control pressure within a hermetic crankcase thereof to thereby change discharging capacity of refrigerant, comprising:

a body having a refrigerant passage formed therethrough;

a valve section including a valve element moving to and away from a valve seat formed in the body so as to adjust a flow rate of refrigerant when part of refrigerant discharged from the variable displacement compressor is caused to flow into the crankcase, and a shaft configured to be axially slidably supported by the body and support the valve element such that the valve element can be caused to operate in unison therewith; and a solenoid including a core fixed within the body, a plunger for moving the valve element forward and backward within the body via the shaft so as to cause the valve element to open and close, and a solenoid coil for generating a magnetic circuit including the plunger and the core by electric current supplied from outside, wherein the plunger is formed by arranging a first plunger opposed to the core, and a second plunger to which an end of the shaft, opposite to the valve element, is connected, in series in an axial direction, the plunger being formed by arranging a pressure-sensing member for sensing suction pressure from a suction chamber, and a hollow cylindrical magnetic member for fixing the pressure-sensing member to the solenoid, between the first and second plungers, wherein the first plunger is configured to be urged in a direction away from the core, and support the second plunger in an axial direction when the solenoid is energized, and wherein the second plunger includes a small-diameter portion inserted into the magnetic member such that a predetermined space is formed therebetween, and a large-diameter portion radially outwardly extending from the small-diameter portion and having an opposed surface formed thereon which is axially opposed to an opposed surface of the magnetic member, the second plunger being urged in a direction away from the first plunger, while the magnetic circuit being formed via the opposed surfaces during energization of the solenoid.

2. The control valve for a variable displacement compressor according to claim 1, wherein an elastic member formed of a non-magnetic material for urging the second plunger in the direction away from the first plunger is disposed between the small-diameter portion of the second plunger and the magnetic member.

3. The control valve for a variable displacement compressor according to claim 1, wherein the first plunger and the core have respective tapered surfaces having complementary shapes to each other formed on opposed surfaces thereof.

4. The control valve for a variable displacement compressor according to claim 1, wherein the second plunger and the magnetic member have respective tapered surfaces having complementary shapes to each other formed on the opposed surfaces thereof.

* * * * *